United States Patent [19]

Kostecki et al.

[11] 3,939,808

[45] Feb. 24, 1976

[54] CIRCULAR MOTION RECIPROCATING ENGINE

[76] Inventors: Bohdan Kostecki; Eugene Kostecki, both of 21 Bath Road, Morley, Australia

[22] Filed: July 2, 1974

[21] Appl. No.: 485,071

[30] Foreign Application Priority Data

July 4, 1973 Australia ..... 3930/73

[52] U.S. Cl. ..... 123/43 R; 123/75 B; 123/90.17

[51] Int. Cl.[2] ..... F02B 57/00; F01L 1/34

[58] Field of Search .... 123/44 R, 43 R, 43 B, 43 C, 123/75 B, 90.17; 91/197

[56] References Cited

UNITED STATES PATENTS

| | | | |
|---|---|---|---|
| 618,157 | 1/1899 | Wolf | 123/43 R |
| 784,808 | 3/1905 | Sawtelle | 123/44 R |
| 975,485 | 11/1910 | Waltman | 123/43 R |
| 1,037,605 | 9/1912 | Eaton | 123/44 R |
| 1,285,835 | 11/1918 | Sunderman | 123/43 R |
| 1,341,332 | 5/1920 | McDonald | 123/43 R |
| 1,380,404 | 6/1921 | Miller | 123/43 R |
| 1,742,706 | 1/1930 | Hermann | 123/44 R |
| 2,886,017 | 5/1959 | Dib | 123/43 R |

FOREIGN PATENTS OR APPLICATIONS

| | | | |
|---|---|---|---|
| 192,811 | 2/1923 | United Kingdom | 123/43 R |

*Primary Examiner*—Carlton R. Croyle
*Assistant Examiner*—Michael Koczo, Jr.
*Attorney, Agent, or Firm*—Fleit & Jacobson

[57] ABSTRACT

A revolving cylinder internal combustion engine in which a rotor carrying a plurality of piston and cylinder assemblies with their axes at right angles to the rotor axis is mounted in an outer body for rotation responsive to reciprocation of the pistons in the cylinders.

In order to improve inlet and exhaust gas control inlet and exhaust to the individual cylinders responsive to rotational movement of the rotor is controlled by cams adjustably carried by the body. Circulation of coolant and/or lubricant through the rotor may be assisted by a centrifugal pumping action responsive to rotor rotation.

17 Claims, 13 Drawing Figures

CIRCULAR MOTION RECIPROCATING ENGINE

THIS INVENTION relates to a revolving cylinder internal combustion engine, that is an internal combustion engine in which a plurality of piston and cylinder assemblies are carried by a rotor for rotation within a stationary body or housing, the piston and cylinder assemblies having their axes extending at right angles to the axis of rotation of the rotor.

It is known that with conventional piston-cylinder arrangements inertia forces are a problem, thus in conventional multi-cylinder internal combustion engines there are major rotating masses which rotate in spaced parallel planes with the direction of reciprocation of the cylinders being parallel one with the other. Also exhaust emission in a conventional engine is difficult to control under different operating conditions for the engine due to the profiles on the cams utilised for controlling the engine being fixed and invariable. This has two effects, firstly the time between the inlet valve closing and exhaust valve opening is fixed and secondly the length of time during which both valves remain open for each cylinder is also fixed. As a result, with conventional engines the flow of gases through the cylinder for efficient clean burning is controlled for any given speed of the engine. This fact shows up in conventional engines when they are running at a low speed the carbon monoxide count in the exhaust is high, falling off as speed of the engine is increased.

According to the present invention there is provided a revolving cylinder internal combustion engine comprising an outer body, a rotor mounted for rotation within the body, a plurality of piston and cylinder assemblies carried by the rotor with their axes extending at right angles to the axis of rotation of the rotor, each of the cylinders having an inlet and an exhaust port provided respectively with inlet and exhaust valves supported for rotation with the rotor, means for rotating the rotor in the body responsive to reciprocating movement of the pistons in the cylinders, and cams carried by the body for co-operation with the inlet and exhaust valves for controlling opening and closing of the valves responsive to the rotational movement of the rotor in the body. Conveniently the means for rotating the rotor in the body responsive to reciprocating movement of the pistons and the cylinders may comprise a circular toothed main gear carried by the body and a plurality of drive gears carried by the rotor and engaging the main gear, each of the drive gears being rotatable in response to reciprocation of an associated one of the pistons. The connection of the piston to the drive gear may be by way of a conventional pivotal connecting rod and crank arrangement or, in an alternative embodiment, drive gears may be driven by an eccentric pin and slot arrangement.

Preferably at least one of the cams is adjustably mounted on the body to permit valve control to be varied. Suitably the position of the cam may be movable circumferentially on the body to vary closing times of the valves controlled thereby relative to the top dead centre position of the pistons in the respective cylinders. Thus conveniently the cams may comprise profiled metal rings upon which the valve stems of inlet and outlet poppet valves ride, the profile of the cam rings governing the operation of the valves within the cylinder head. Preferably each cam comprises an adjustably displaceable portion movable to vary the dwell time at which valves controlled by that cam are open relative to rotational displacement of the rotor.

The invention will be described, by way of example, with reference to the accompanying drawings, in which.

Figure 1:
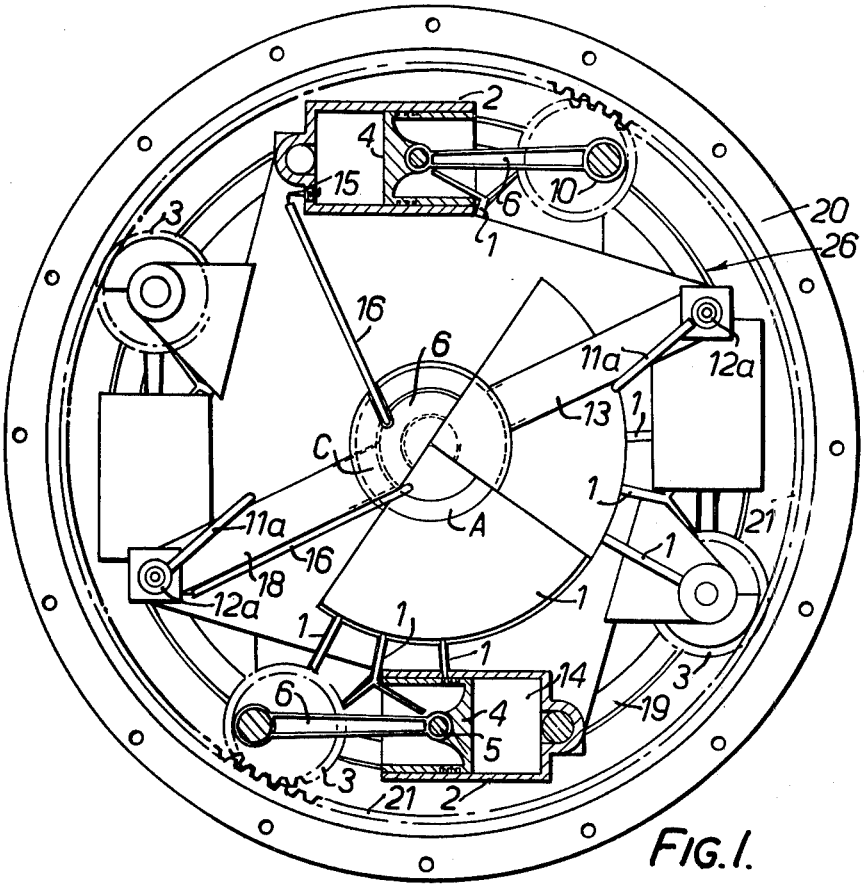
FIG. 1 is a diagrammatic elevational view, with parts broken away, of an air cooled revolving cylinder internal combustion engine embodying the invention.

Referring to FIGS. 1 to 4 of the drawings, an internal combustion engine is shown as comprising a body formed of two housing or casing parts 20 and 20*a*. Mounted between bearings 22, 22*a* in the housing parts is a shaft 24 carrying a rotor 26 within the body. The rotor 26 carries four cylinders 2 each containing a piston 4 connected by a pivotal connecting rod 6 to a crank 10 of a drive gear 3. Each of the drive gears 3 meshes with a circular main gear 21 carried by the housing part, whereby reciprocation of the pistons 4 in the cylinders 2 will cause rotation of the drive gears 3 carried by the rotor 26 which by engagement with the main gear 21 will cause rotation of the rotor 26 about the axis of the shaft.

Each of the cylinders 2 is provided with an inlet valve 25*a* and an outlet valve 25 biased to a valve closed position by springs 23. An exhaust valve control cam 19 is mounted to the interior of the casing 20 and an inlet valve control cam 19*a* is mounted on the inside of casing 20*a*. The position of each cam is adjustable on the associated casing. The valve control cams are arranged to extend circumferentially in the housing so that upon rotation of the rotor 26 valve control rods 12 and 12*a* of the valves 25 and 25*a* ride on the cams to control opening of the respective valves.

Figure 2:
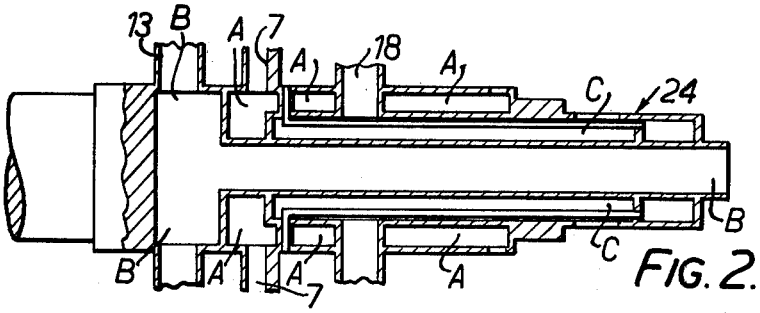
FIG. 2 is a longitudinal sectional view illustrating an arrangement of inlet ducts for the engine of FIG. 1.
Figure 3:
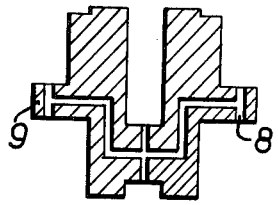
FIG. 3 is an axial section of a drive gear utilised in the engine of FIG. 1.
Figure 4:
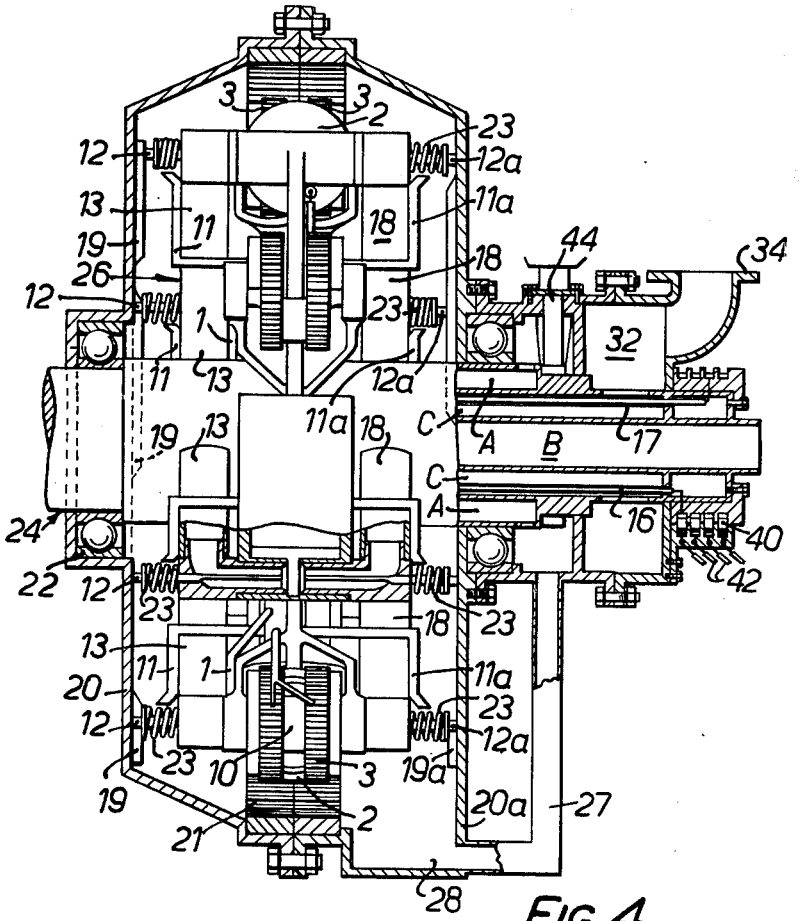
FIG. 4 is a diagrammatic view partly in longitudinal section of the engine of FIG. 1.

The flow of fuel to the cylinders 2 and exhaust from the cylinders 2 as well as supply of oil to the rotor 26 is provided by passages extending axially of the shaft 24 as best seen in FIG. 2. Thus an exhaust port 13 from each exhaust valve communicates with an exhaust passage B extending centrally of the shaft 24 while an inlet port 18 for each cylinder communicates with an annular inlet passage C extending axially of the shaft 24 to a series of inlet ports 30 communicating with a plenum chamber 32 fed from a carburettor not shown, to be mounted on the flange 34 shown in FIG. 4. With this arrangement fuel laden air from the carburettor passes through the passage C to the inlet ports 18 of the various cylinders 2 while exhaust gases from those cylinders pass from the exhaust ports 13 to the exhaust passage B. Also provided within the shaft is an oil supply passage as shown at A for supplying lubricating oil to moving parts of the engine.

Generally the lubrication system comprises the inlet passage A which communicates with four oil chambers of which one is shown at 7 in FIG. 1. There is one oil chamber for supplying oil to each individual cylinder and its associated components although instead there may be used a single annular oil chamber 7. Lubricating channels 1 lead from the periphery of the oil chamber 7 to lubricate the cylinders 2 and various moving components. Thus certain of the channels 1 lead to bearings supporting the drive gears 3 which include stub shafts 9 received in such bearings. Conduits 8 lead within the drive gears 3 from the bearings to provide lubrication to the bearing of the eccentric crank 10 engaged by the connecting rod 6. Oil conduits 11 and 11*a* also lead from the oil chamber 10 for supplying oil to cams 19 and 19*a* engaged by the valve stems 12 and 12*a*. During rotation of the rotor oil is urged centrifugally from the or each oil chamber 7 through the lubricating channels 1 and 11 to the various moving components. A sump 28 is provided in the bottom of the housing formed by the casing 20 and 20*a* and is connected by a delivery tube 27 to the oil inlet passage A. A separate oil pump may be provided for circulating oil through the lubricating system should insufficient circulation be achieved from the self pumping action of the lubricating system itself although in general it is to be expected that an adequate centrifugal pumping action will be obtained from the system as illustrated responsive to rotation of the rotor.

Each of the cylinders is provided with a sparking plug 15 connected by an insulated connector 16 with respective ones of conductors carried for rotation by the shaft and respectively engageable by brushes 40 connected by leads 42 to a distributor 44. The distributor 44 is driven by a gear 29 carried by the shaft 24 for rotation therewith. With the illustrated arrangement the distributor 44 of FIG. 4 delivers a properly timed electrical impulse to each of the leads 42 in turn whereby each of the sparking plugs 15 will cause ignition three times during each rotation of the rotor 26. Thus with the particular arrangement illustrated three working circles of each piston and cylinder will occur during each rotation of the rotor as a whole.

The distributor 44 can be arranged to have its timing controlled in response to variations in speed of the rotor 26, for example by using a conventional vacuum advance and retard control, while the adjustable cams 19 and 19*a* can be properly positioned on the casings 20 and 20*a* in order to provide the optimum valve opening and valve closing positions in relation to strokes of the pistons 4 in their associated cylinders 2 in order to obtain optimum operating characteristics for the engine under the particular working conditions under which it is required to operate.

Figure 5:
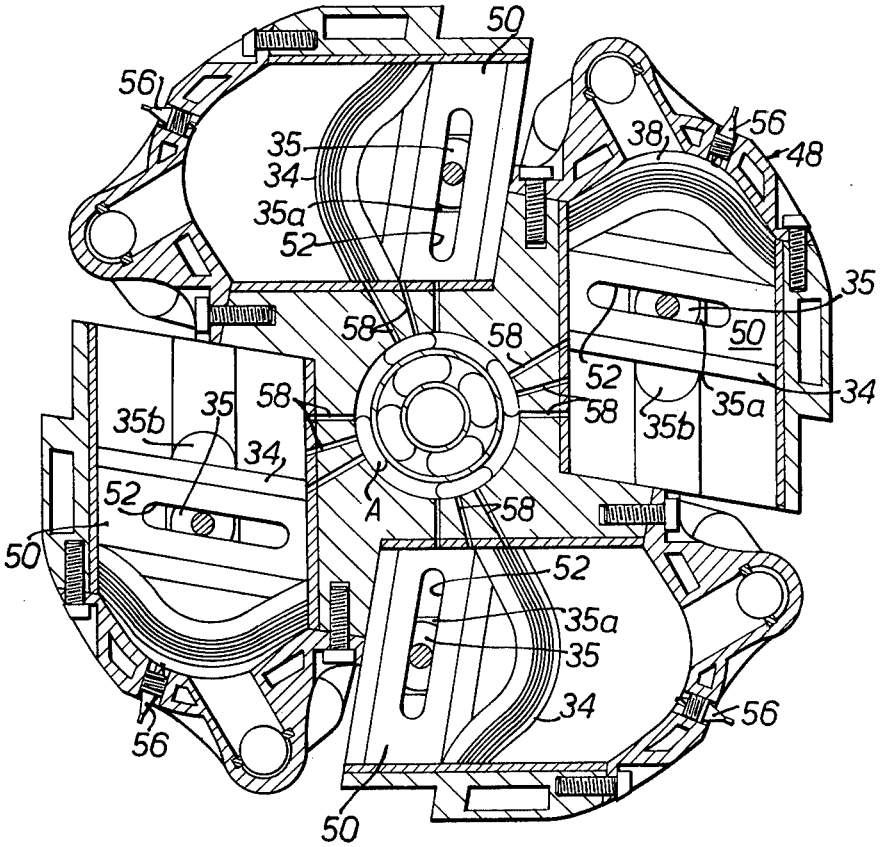
FIG. 5 is a cross sectional view of a further embodiment of rotating piston-cylinder reciprocating internal combustion engine in which the cylinders are liquid cooled.
Figure 6:
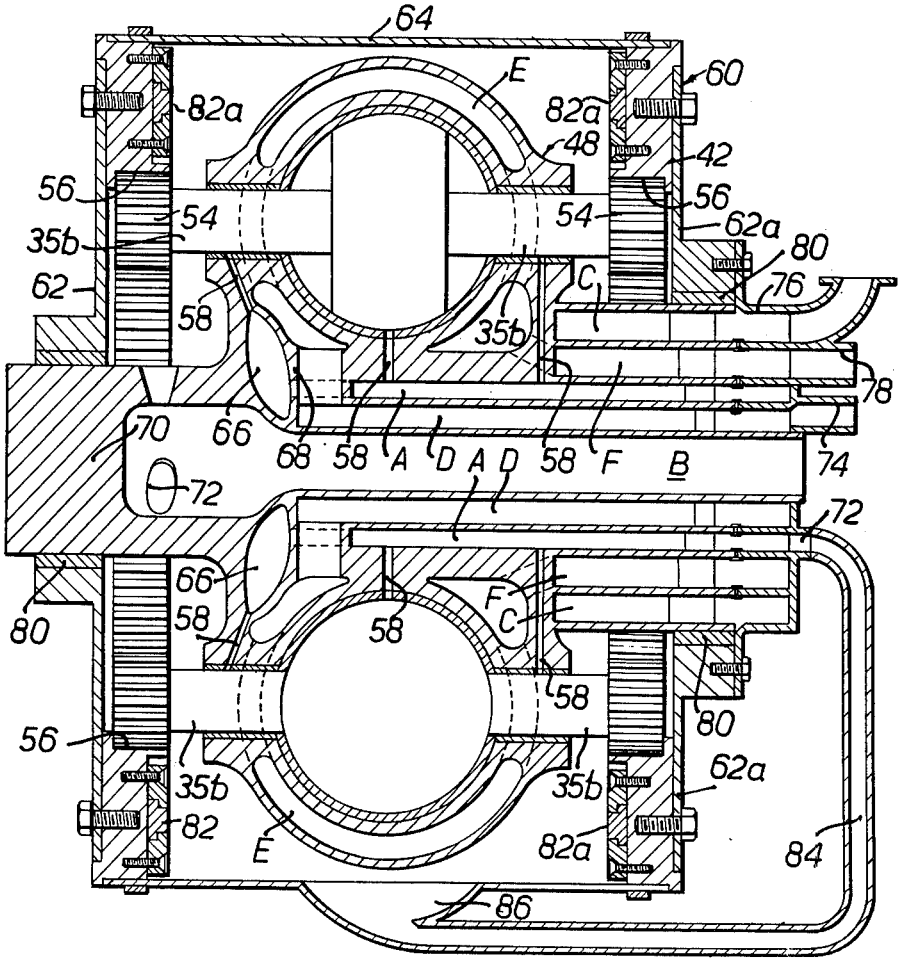
FIG. 6 is a diagrammatic cross sectional view of the engine including the rotor of FIG. 1.

FIG. 5 illustrates in cross-section a rotor 48 of a liquid cooled engine embodying the invention. As shown the rotor 48 comprises four working cylinders 38 each containing a piston 34. The cylinders 38 are each provided with a domed head and the pistons 34 themselves are also domed. The pistons 34 are provided each with a base portion 50 having a slot 52 extending therethrough. Received within the slot 52 is a bearing 35*a* through which extends a crank portion of a driving crank 35*b* which is connected with drive gears 54 (FIG. 6) in meshing engagement with annular main gears 56 (FIG. 6). It will be apparent that with this arrangement reciprocation of the pistons 34 will cause rotation of the drive gears 54, the crank bearing 35*a* moving to and fro in the slot 52 transversely of the direction of piston movement during such piston reciprocating movement. As shown in FIG. 5 each cylinder is provided with a sparking plug 56 and also a central shaft portion of the rotor includes a passage A for the supply of lubricating fluid communicating with the cylinders 38 by supply ducts 58, an annular passage D for the supply of cooling liquid to the cylinders 38 and a central exhaust outlet passage B.

FIG. 6 illustrates the rotor 48 of FIG. 5 mounted in a body or housing 60 constituted by end walls 62, 62*a* and a peripheral casing 64. The main gears 56 engaged by the drive gears 54 are in the form of two annular members provided at a peripheral inner surface with the gear teeth engaged by the drive gears 54, each of the annular members serving as a connecting member between an end wall 62 or 62*a* and the casing 64 of the housing 60. Lubrication channels 58 are shown leading to the bearings in the cylinders supporting the crank 35*b*, the left-hand ducts 58 shown in FIG. 6 communicating with the oil inlet passage A via an oil chamber 66. The water inlet passage D is shown communicating with the jackets E around the cylinders by means of inlet ducts 68 while a water outlet passage F is shown also in the shaft portion of the rotor 48. About the passage F is provided an inlet C for an air/fuel mixture. With the arrangement shown the drive from the engine will be taken via the left-hand end 70 of the rotor shaft while at the right-hand end fixed seal connections are provided for connection at 72, 74, 76 and 78 respectively for the supply of oil to the oil passage A, for the supply of cooling liquid to the coolant inlet passage D, for the supply of the fuel/air mixture to the inlet passage C and for receiving coolant from the coolant outlet passage F for direction to a radiator or the like. The rotor 48 itself is supported by the housing via bearings 80. Cam rings 82 and 82*a* are shown mounted to the inner end walls 62 and 62*a* of the housing 60 for controlling inlet and outlet ports of the cylinders. The connection for oil inlet to the inlet passage A is shown by means of a line 84 leading from a sump 86 formed at the bottom of the housing 60.

Figure 7:
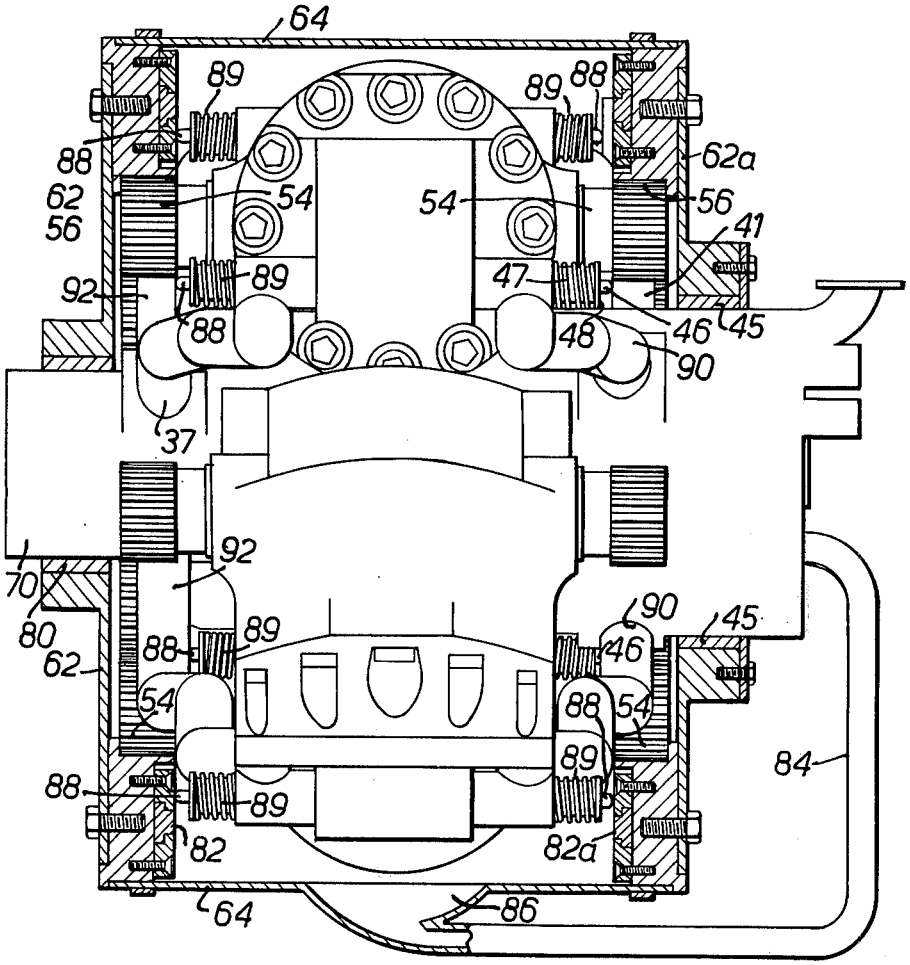
FIG. 7 is a diagrammatic part cross sectional view of the engine including the rotor but with the rotor rotated through 45° from the position of FIG. 6.

From the view of FIG. 7 can be seen the valve control rods 88 urged outwardly by valve springs 89 into contact with the cams 82 and 82*a*. Also shown are inlet ducts 90 which communicate with inlet passage C and outlet ducts 92 which communicate with the exhaust passage B.

Figure 8:
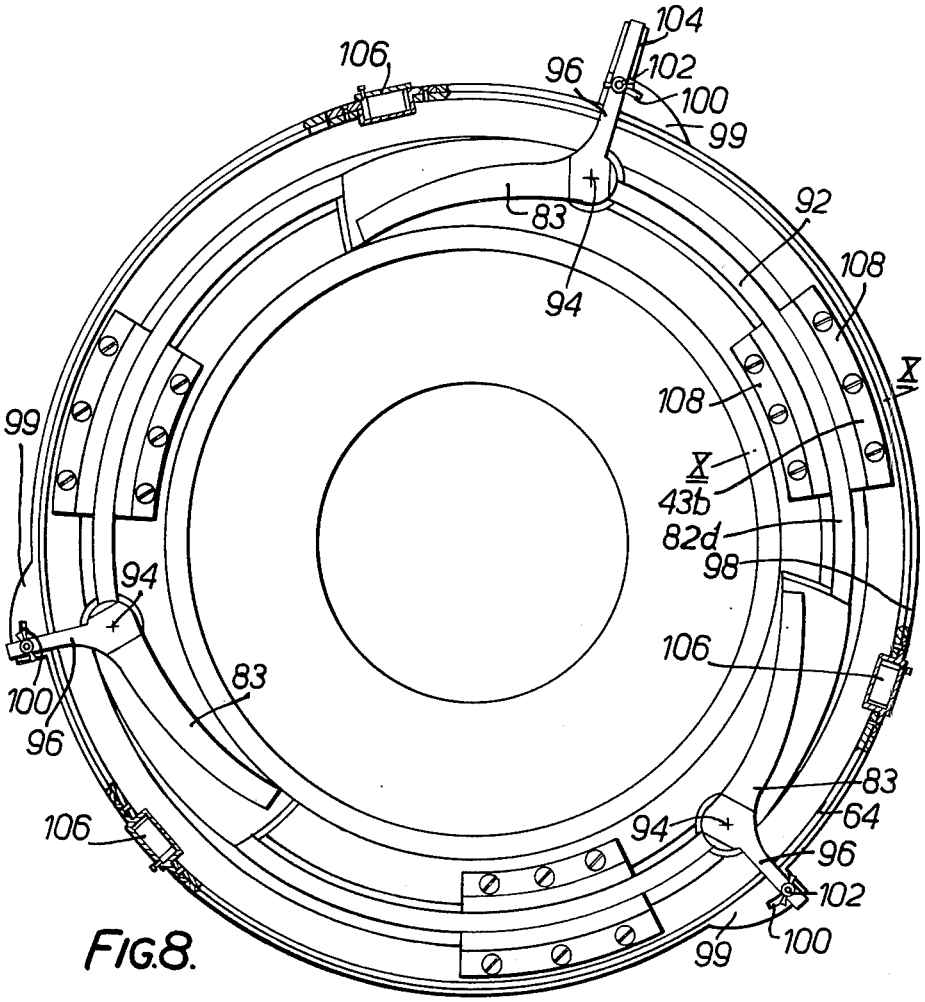
FIG. 8 is a diagrammatic view illustrating a manner of mounting a cam ring for controlling the inlet valve of the engine.

FIG. 8 illustrates in greater detail the arrangement of the controllable inlet cam 82*a*. The annular inlet cam 82*a* is shown with an arrangement by which each inlet valve is opened three times during each revolution of the rotor. The inlet cam 82*a* for the major portion of its circumferential length comprises a low track portion 92 which when engaged by the valve rod 88 of an inlet valve permits that inlet valve to be held in its closed position by the action of the associated valve spring 89. At three locations around the periphery of the cam 82*a* are provided adjustably displaceable portions 83 which are pivotally mounted to the cam 82*a*. Each adjustably displaceable portion 83 has a low part L corresponding in height with the track portion 92 of the cam 82*a* and a high part H. The relative proportions of the high and low parts of each adjustably displaceable portion lying in the path of movement of the valve rods is adjustable by changing the pivotal position of the adjustably displaceable portion 83 about the axis 94. Accordingly during operation of the engine an inlet valve rod tracking around the cam 82*a* will be opened at the time it passes over the high portion H of the displaceable portion 83, the proportion of the rotational movement of the rotor during which each valve controlled by the cam 82*a* is opened depending upon the adjusted pivotal position of each displaceable portion 83.

Each displaceable portion 83 is provided with a control arm 96 which is securable to a control ring 98 mounted for rotational movement about the periphery of the casing 64. The control ring 98 is provided with three projections 99 each having a slot 100 receiving an adjustment bolt 102 from associated ones of the control arms 96. By adjusting the position of the bolt 102 in its associated slot 100 the pivotal position of the displaceable portions 83 of the cam ring 82*a* may be adjusted as required. The control ring 98 itself is displaceable about the periphery of the casing 64 by means of a control projection 104 whereby simply by controlled movement of the control ring the high portions H of the control cam 82*a* can be simultaneously moved relative to the housing for advancing or retarding as required the opening and closing times of the controlled inlet valves relative to top dead centre of the pistons in the cylinders. Conveniently the circumferential position of the control ring can be controlled responsive to engine speed, for example by means of a fuel inlet vacuum pressure as used for controlling the timing of a distributor in a conventional internal combustion engine.

Figure 11:
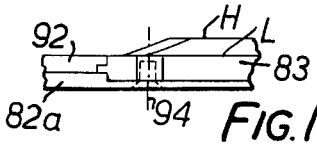
FIG. 11 is a diagrammatic sectional view of a detail of the cam ring shown in FIG. 8.

FIG. 11 shows the manner in which the cam 82*a* comprises a base ring carrying individual low track sections 92 and having the displaceable portions 83 pivotally secured thereto at 94.

Figure 10:
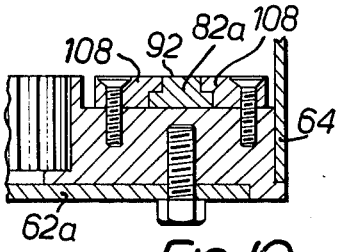
FIG. 10 is a cross-sectional detail view taken along line X—X of FIG. 8.

FIG. 10 illustrates the manner in which the cam ring 82*a* is slidably secured to the member carrying the gear 58 by clamping slide members 108.

A similar arrangement is provided for controlling the exhaust valves of the engine.

Figure 9:
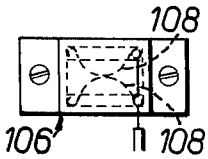
FIG. 9 is a plan view of an electrical contact carried by the engine body.

Shown in FIG. 8 are fixed contacts 106 for the supply of electrical impulses to the individual sparking plugs. The contact 106 comprises, as shown in FIG. 9, two bowed conducting portions 108 which receive a conductor on the end of the sparking plug therebetween for supply of electrical current thereto. While the contacts 106 are shown as fixed to the casing 64 they may themselves be attached to a ring about the housing the position of which is rotatably adjustable to vary the position of the contacts and thus the time of ignition relative to piston top dead centre. Normally, however, such control is not necessary, adequate control of operating conditions within the cylinders being given by simultaneous control of time of opening and closing of the inlet and outlet valves by movement of the inlet and outlet valve control cams. Alternatively the contacts 106 may be extended so that they provide a contact with the individual sparking plugs along a substantial arcuate path with the supply of electrical impulses to the contacts being controlled by a separate conventional type of distributor. Alternatively again instead of using exteriorly mounted contacts 106 the supply of electrical impulses to the sparking plugs may be made in a manner similar to that described in relation to the embodiment of FIGS. 1 to 4.

Utilising the arrangement of contacts 106 for supplying electrical impulses to the sparking plugs of the engine insulation needs to be provided for preventing leakage of electric current from the contacts other than to the sparking plugs. Conveniently this can be done by utilising a sprayed-on insulating material.

With operation of both the described embodiments the gearing between the drive gears and the main gears is such that each piston and cylinder has three power strokes during each revolution of the rotor, the engine operating, in the embodiments shown, with a four stroke cycle. It will be appreciated that the principles of the invention are also applicable to engines operating on a two stroke, diesel or other cycle. Due to the diametrical opposite arrangement of the cylinders the pistons of diametrically opposite cylinders reciprocate relative to the cylinders in opposite directions in order to provide a counterbalancing effect. Consequently during rotation of the engine a very smooth balanced output is obtained. With both embodiments fuel is fed axially through inlet passages C in the supporting shaft and from thence led via the inlet valves to the individual cylinders as required. The exhaust from the exhaust valves of the individual cylinders is led from the engine through the central exhaust passage B extending axially of the shaft. Also in both embodiments an oil inlet passage A is provided within the supporting shaft, oil being pumped from this inlet passage by centrifugal action during rotation of the rotor, individual channels being provided for conducting the oil flow to the various components requiring lubrication. The housing body itself acts as a sump for collecting oil for recirculation to the inlet passage A. Normally adequate oil circulation is obtained by the pumping action of the engine although if necessary a separate oil pump may be provided in the feed line from the sump. In the embodiment of FIGS. 5 to 11, also the circulation of coolant liquid from the inlet passage D through the jacket around the cylinder to the outlet passage F is produced by the centrifugal pumping action arising during rotation of the rotor.

Figure 12:
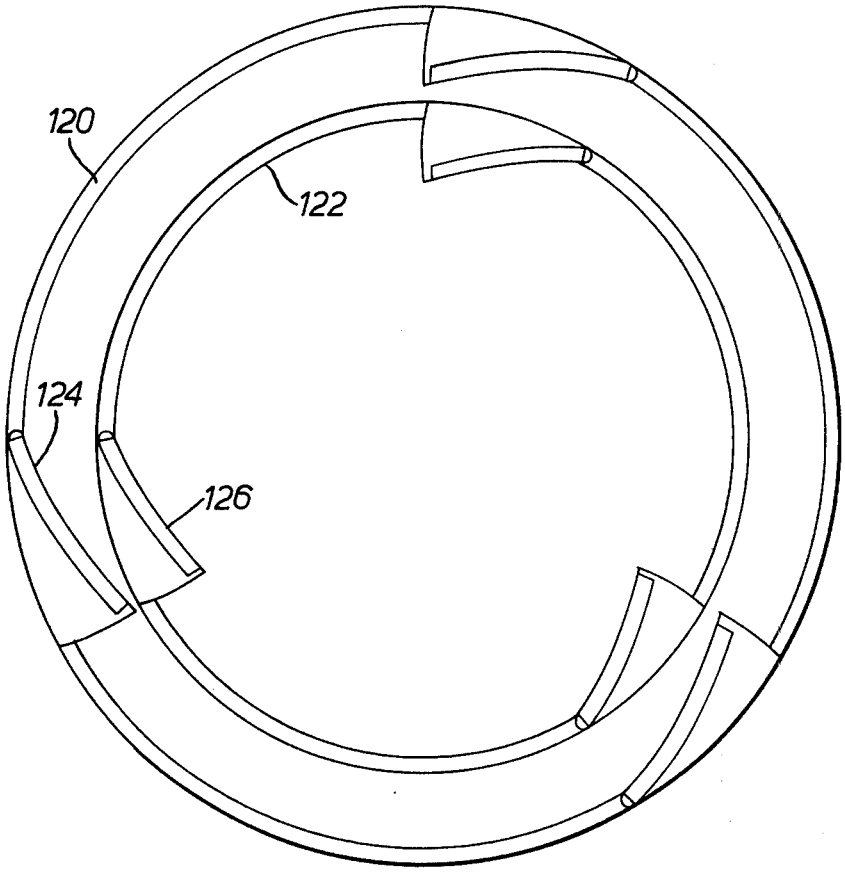
FIG. 12 is a diagrammatic view of a modified inlet valve control cam arrangement where two inlet valves are provided to each cylinder.
Figure 13:
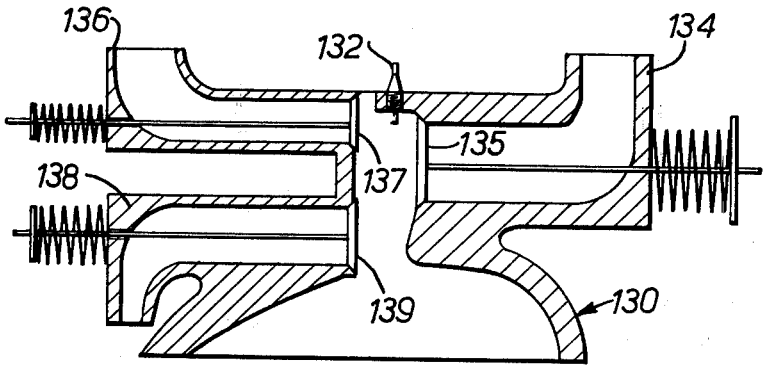
FIG. 13 is a diagrammatic sectional view showing a cylinder head and inlet valve arrangement for use in an engine utilising the twin inlet valve control cams shown in FIG. 12.

Instead of having a single inlet valve to each chamber as described above two inlet valves may be provided as shown in FIG. 13. In FIG. 13 a cylinder head 130 is shown as comprising a single exhaust outlet 134 provided with an exhaust valve 135 and two inlets 136 and 138 provided respectively with control valves 137 and 139. Separate fuel supply passages are provided for supplying fuel air mixture to the respective inlets 136 and 138, the outer inlet 136 being arranged to receive a rich fuel air mixture and the inlet 138 being arranged to receive a lean fuel air mixture from respective fuel supply chambers in the service shaft. The rich fuel inlet valve 137 is controlled by a cam ring 120 shown in FIG. 12 as being provided with dwell control cams 124. Similarly a cam ring 122 provided with dwell control cams 126 shown in FIG. 12 for controlling the lean fuel inlet control valve 139. The cam rings 120 and 122 are independently controllable circumferentially for adjusting the time at which the valves are opened relative to piston displacement as explained previously while the dwell control cams 124 and 126 are independently movable for controlling the relative length of time of opening of the rich and lean fuel inlet valves. With this arrangement it is possible to provide for subsequent ignition by the sparking plug 132, a variable fuel/air mixture stratification in the cylinder utilising the variable cam. By being able to vary the two inlet fuel/air flows into the chamber it is possible to control not only when the fuel enters the cylinder and the length of time during which the fuel will enter the cylinder, but also the degree of stratification of fuel in the cylinder. That is, for any given load condition or speed condition the amount of rich fuel entry to the amount of lean fuel entry into the cylinder can be controlled to satisfy the requirements of the motor at that given time, then richer fuel/air mixture being adjacent the sparking plug for easy ignition and the leaner fuel/air mixture being adjacent the piston.

It will be appreciated that generally a very simple engine construction has been described giving a balanced arrangement of the moving parts and also permitting very ready and simple control of valve opening giving the user of the engine the opportunity carefully to adjust its operating characteristics to its conditions of use such that it will operate very efficiently while at the same time having good combustion properties providing for a clean exhaust. Thus by being able to control the positioning of the valve control cams and, preferably, by also being able to control the dwell timing of the cams to maintain the valves open, this control being possible either manually or through a reflex adaptor, for example a vacuum control mechanism of the type used to advance or retard the timing in a conventional distributor, it is possible to obtain very good control of the engine characteristics. Thus if both inlet and outlet cams were rotated by the same amount in the same direction this would have an effect equivalent to advancing or retarding ignition of a charge in the cylinder relative to the valve opening and closing times. Also with the independent control of the cams a very full and efficient control of the flow of gases through each cylinder is possible to match the optimum for any required engine operating conditions. The engine itself, because of the high power which is obtainable with a relatively light and small dimensioned engine, is particularly suitable for use in vehicles. Because of its balanced and vibration free operation the engine is of especial interest for use in aircraft. However it is also highly suitable for use in stationary locations as well as for marine applications since in these two latter cases an engine may often be required to act under steady state conditions where exact and careful control of the operating parameters of the engine can be of extreme benefit.

We claim:

1. A revolving cylinder internal combustion engine comprising an outer body, a rotor mounted for rotation within the body, a plurality of piston and cylinder assemblies carried by the rotor and having axes extending at right angles to the axis of rotation of the rotor, each of the cylinders having an inlet and an exhaust port provided respectively with inlet and exhaust valves supported for rotation with the rotor, means for rotating the rotor in the body responsive to reciprocating movement of the pistons in the cylinders, and cams carried by the body for co-operation with the inlet and exhaust valves for controlling opening and closing of the valves responsive to the rotational movement of the rotor in the body, at least one of the cams comprising an adjustable portion displaceable relative to the remainder of the cam to change the cam profile to vary the dwell time proportion of rotational movement of the rotor during which each valve controlled by the cam is open.

2. An internal combustion engine according to claim 1, wherein the means for rotating the rotor in the body responsive to reciprocating movement of the pistons in the cylinders comprises a circular toothed main gear carried by the body and and a plurality of drive gears carried by the rotor and engaging the main gear, each of the drive gears being rotatable in response to reciprocation of an associated one of the pistons.

3. An internal combustion engine according to claim 2, comprising an eccentric pin and slot arrangement for driving the drive gears, each of the drive gears being provided with an axially extending pin eccentric from the axis of rotation thereof and engaging in a slot in the piston whereby reciprocation of the piston moves the eccentric to cause rotation of the drive gear.

4. An internal combustion engine according to claim 1, wherein the displaceable portion has a high dwell portion of the cam thereon and is pivotally movable to vary the proportion of high dwell portion which is co-operable with the valves controlled by the cam.

5. An internal combustion engine according to claim 4, wherein the cam is in the form of a ring concentric with the axis of the rotor, the displaceable portion being pivotally carried by the ring.

6. An internal combustion engine according to claim 5, including a plurality of displaceable portions carried by the cam ring.

7. An internal combustion engine according to claim 6, including a control ring provided about the body for simultaneously controlling said displaceable portions.

8. An internal combustion engine according to claim 7, wherein the displaceable portions each have a control arm individual thereto adjustably secured to the control ring.

9. An internal combustion engine according to claim 7, wherein both the cam controlling the inlet valves and the cam controlling the outlet valves are controllable.

10. An internal combustion engine according to claim 1, which comprises two fuel inlet valves for each cylinder and a separate adjustable cam controlling each of the inlet valves.

11. An internal combustion engine according to claim 1, including an electrical contact carried by the body for supplying electrical impulses to sparking plugs mounted with the respective cylinders.

12. An internal combustion engine according to claim 11, including a plurality of said electrical contacts spaced about the circumference of the body.

13. An internal combustion engine according to claim 12, including a ring mounted on the housing and carrying the electrical contacts, the position of the ring being rotatably adjustable about the housing to vary the time of ignition relative to piston top dead centre.

14. An internal combustion engine according to claim 1, comprising a rotor supporting shaft mounted for rotation within the body, the shaft having axial passages defined therein for conducting fuel/air mixture to and exhaust gases from the respective cylinders.

15. An internal combustion engine according to claim 1, comprising a rotor supporting shaft, an oil inlet passage extending axially of the shaft and oil channels connecting the oil inlet passage to those components of the engine on the rotor requiring lubrication, the circulation of oil through the inlet passage to the components requiring lubrication being at least assisted by a centrifugal pumping action consequent upon rotation of the rotor.

16. An internal combustion engine according to claim 1, comprising a rotor supporting shaft, a liquid cooling jacket about each cylinder, and inlet and outlet passages for the flow of coolant to and from the jackets extending axially of the shaft.

17. An internal combustion engine according to claim 1, wherein at least one of the cams is mounted on the body for movement circumferentially of the body to permit valve control to be varied, the cam being movable circumferentially on the body to vary opening and closing times of the valves controlled thereby relative to the top dead centre position of the pistons in the respective cylinders.

* * * * *